US008931934B2

(12) United States Patent
Lin

(10) Patent No.: US 8,931,934 B2
(45) Date of Patent: Jan. 13, 2015

(54) LED LAMP WITH VERTICAL AIRFLOW CHANNEL

(75) Inventor: Chu-Keng Lin, Miao-Li (TW)

(73) Assignee: ScienBiziP Consulting (Shenzhen) Co., Ltd., Guangdong (CN)

( * ) Notice: Subject to any disclaimer, the term of this patent is extended or adjusted under 35 U.S.C. 154(b) by 62 days.

(21) Appl. No.: 13/531,592

(22) Filed: Jun. 25, 2012

(65) Prior Publication Data

US 2013/0100662 A1 Apr. 25, 2013

(30) Foreign Application Priority Data

Oct. 21, 2011 (TW) ..... 100138405

(51) Int. Cl.

| | |
|---|---|
| ***F21V 5/00*** | (2006.01) |
| ***F21V 29/00*** | (2006.01) |
| ***F21K 99/00*** | (2010.01) |
| *F21V 5/04* | (2006.01) |
| *F21V 31/00* | (2006.01) |
| *F21S 8/04* | (2006.01) |
| *F21V 23/06* | (2006.01) |
| *F21Y 101/02* | (2006.01) |

(52) U.S. Cl.

CPC ..... *F21V 29/225* (2013.01); *F21V 29/2293* (2013.01); *F21K 9/00* (2013.01); *F21V 5/04* (2013.01); *F21V 31/00* (2013.01); *F21S 8/043* (2013.01); *F21V 5/007* (2013.01); *F21V 23/06* (2013.01); *F21Y 2101/02* (2013.01)

USPC ..... 362/373; 362/294

(58) Field of Classification Search

CPC ..... F21V 29/2212; F21V 29/2243; F21V 29/225; F21V 29/2293

USPC ..... 362/373, 294, 249.02

See application file for complete search history.

(56) References Cited

U.S. PATENT DOCUMENTS

| | | | | |
|---|---|---|---|---|
| 8,419,224 | B2 * | 4/2013 | Wan-Chih et al. | 362/294 |
| 2012/0033419 | A1 * | 2/2012 | Kim et al. | 362/235 |
| 2012/0256206 | A1 * | 10/2012 | Cho | 257/88 |

* cited by examiner

*Primary Examiner* — Diane Lee
*Assistant Examiner* — Kenny C Sokolowski
(74) *Attorney, Agent, or Firm* — Novak Druce Connolly Bove + Quigg LLP

(57) ABSTRACT

An LED lamp includes a heat sink, a lamp shell and a light module. The heat sink includes a substrate and a plurality of fins. The substrate has a top surface and a bottom surface. The lamp shell is fixed to a periphery of the substrate. The light module is received between the lamp shell and the bottom surface of the substrate of the heat sink. The substrate defines a first through-hole through the top and bottom surfaces thereof to communicate airflow channels between the fins with a space below the bottom surface of the substrate, wherein the light module is received in the space.

14 Claims, 4 Drawing Sheets

LED LAMP WITH VERTICAL AIRFLOW CHANNEL

BACKGROUND

1. Technical Field

The present disclosure relates to lighting apparatus, and more particularly, to an LED lamp having vertical airflow channels.

2. Description of Related Art

Light emitting diodes (LEDs) have many advantages, such as high luminosity, low operational voltage, low power consumption, compatibility with integrated circuits, easy driving, long term reliability, and environmental friendliness. Such advantages have promoted the wide use of LEDs as a light source. Now, LED lamps are commonly applied in lighting. However, wavelength of the light emitted by the LED lamps will have redshift if the heat generated by the LED lamp lighting device accumulates. So heat sinks for LED lamps are needed. Cooling fins are used in the heat sinks to increase heat exchange of the lamps. The cooling fins are mounted on lamp shells of the lamps. However, due to block of the lamp shells of the lamps, airflow channels defined between the cooling fins can only extend along horizontal directions. That is to say, the airflow can only flow through the channels along the horizontal direction, resulting in poor heat dissipation effect of the lamps.

What is needed, therefore, is an LED lamp having good heat dissipation effect.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the views.

DETAILED DESCRIPTION

Figure 1:
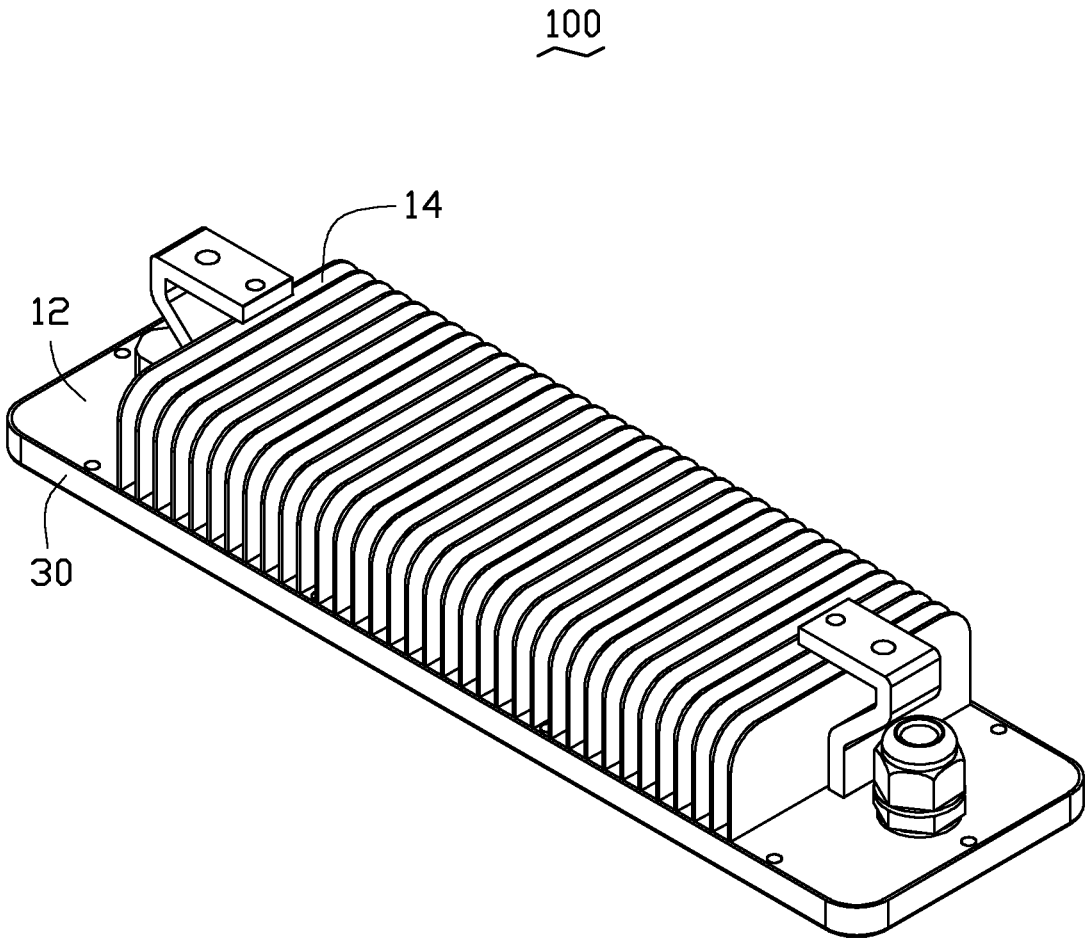
FIG. 1 is an isometric, assembled view of an LED lamp in accordance with an embodiment of the present disclosure.
Figure 2:
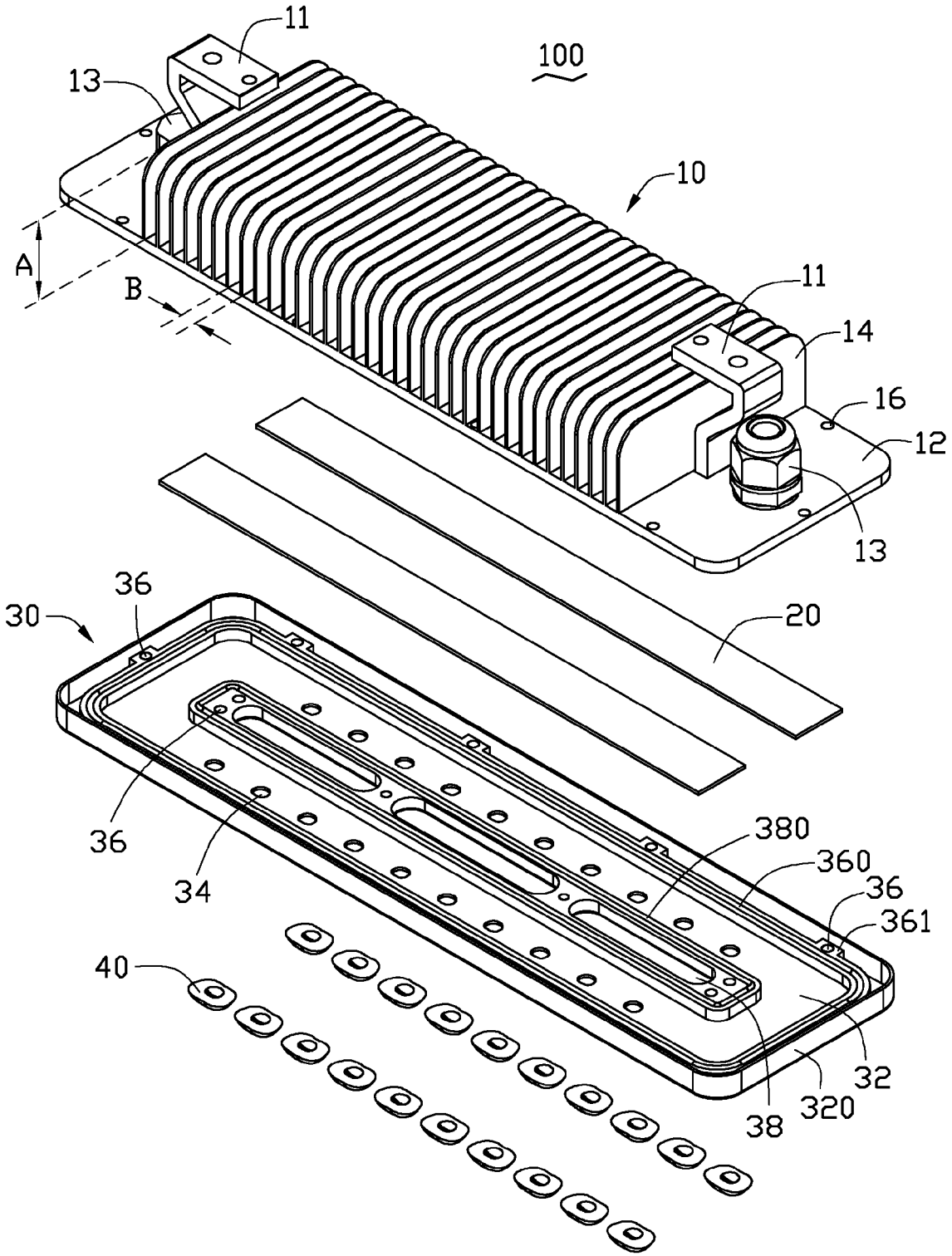
FIG. 2 is an exploded view of FIG. 1.

Referring to FIGS. 1-2, an LED lamp 100 in accordance with an embodiment of the present disclosure is shown. The LED lamp 100 includes a heat sink 10, two light modules 20, a lamp shell 30 and a plurality of lenses 40. The heat sink 10 is located on a top of the LED lamp 100. The two light modules 20 are fixed on a bottom of the heat sink 10. The lamp shell 30 covers the two light modules 20 and is fixed on the bottom of the heat sink 10. The lenses 40 are attached to a bottom of the lamp shell 30. The heat sink 10 is made of metal, preferably an aluminum alloy. The shell 30 and the lenses 40 are made of light permeable plastic, preferably polymethyl methacrylate (PMMA).

The heat sink 10 includes a substrate 12. The substrate 12 is a rectangular plate including a top surface, a bottom surface and a lateral surface. The lateral surface consists of a front face, a rear face, a left face and a right face. Several rectangular thin fins 14 extend upwardly from the top surface of the substrate 12. The fins 14 are perpendicular to the top surface of the substrate 12 and parallel to the left face and the right face. Each fin 14 spans across the substrate 12 and extends from the front face to the rear face of the substrate 12. The length of each of the fins 14 can be greater or less than a width of the substrate 12. Each fin 14 has a height A ranging between 20 mm and 30 mm, such as 24 mm, 25 mm, 29 mm etc. In this embodiment, the height A is preferably 25 mm. Every two adjacent fins 14 are spaced from each other via a distance B ranging between 3 mm and 8 mm. In this embodiment, the distance B is preferably 6 mm. A ratio of the height A to the distance B is changeable if such an adjustment is needed for meeting the mounting condition of the LED lamp 100 while it will not unduly affect the heat dissipation capability of the heat sink 10. Preferably, the ratio of the height A to the distance B is 8:3. The substrate 12 forms two brackets 11 on a left side of a leftmost fin 14 and on a right side of a rightmost fin 14 respectively. The two brackets 11 are used to connect the LED lamp 100 to an external device (not shown) such as a ceiling. Two electrical connectors 13 are extended from a left side and a right side of the substrate 12. The two electrical connectors 12 are located near the left face and the right face of the substrate 12, respectively. The two electrical connectors 13 are used to allow wires (not shown) to extend therethrough, wherein the wires are used for electrically connecting the LED lamp 100 with an external power source.

Figure 3:
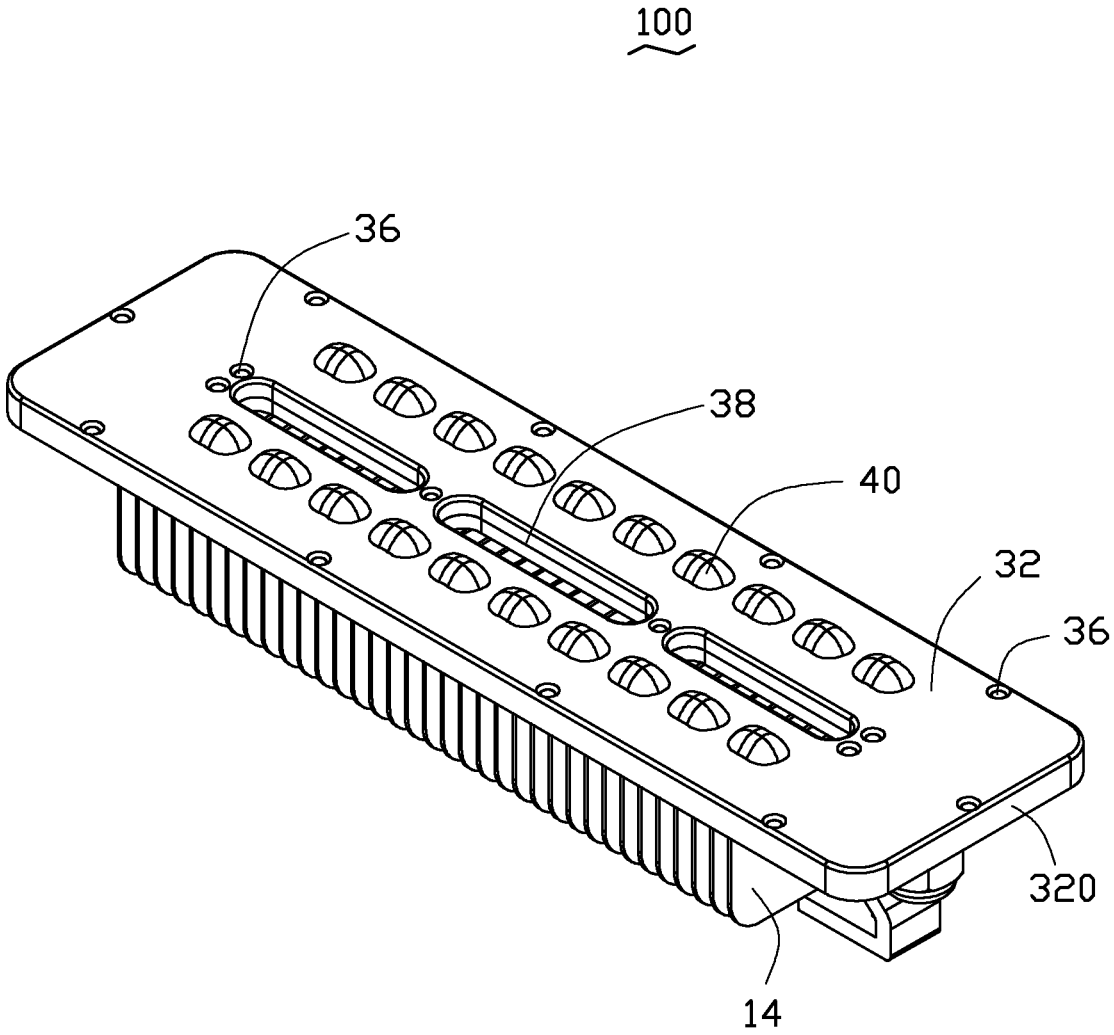
FIG. 3 is similar to FIG. 1, but from another aspect.
Figure 4:
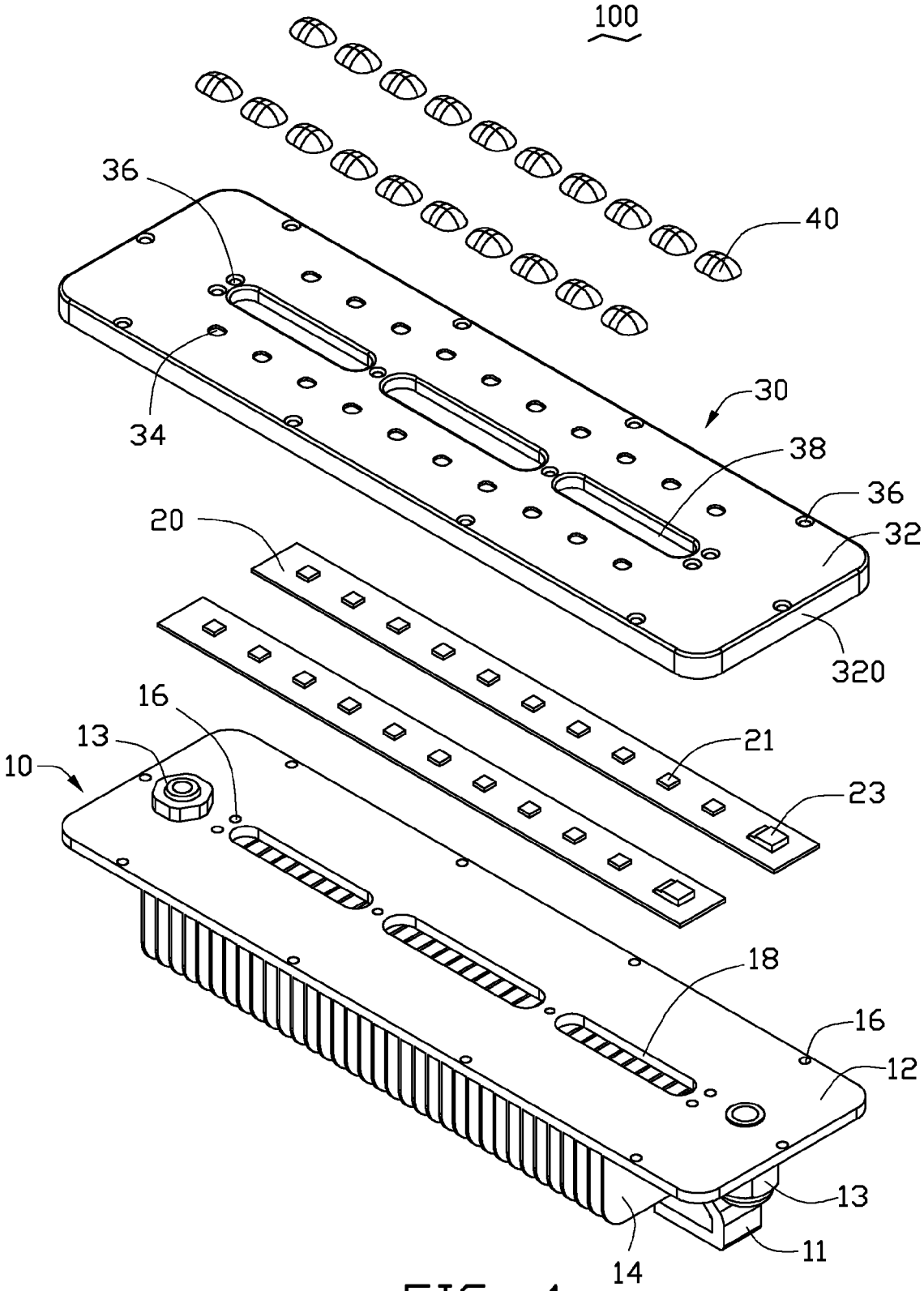
FIG. 4 is an exploded view of FIG. 3.

Also referring to FIGS. 3-4, three strip-shaped through-holes 18 are defined in the substrate 12 and extend along a lengthwise direction thereof. The three through-holes are located at a middle of the substrate 12. The three through-holes 18 are positioned in alignment with each other along a left-to-right direction. The three through-holes 18 are similar in shape. Long edges of the three through-holes 18 are parallel to the front face and the rear face of the substrate 12. Left edges and right edges of the three through-holes are arc-shaped. Widths of the three though-holes 18 are far less than lengths of the three through-holes 18. A middle one of the three through-holes 18 has a size slightly larger than that of the other two of the three through-holes 18. The substrate 12 further includes a plurality of holes 16 defined adjacent to the front, rear, left and right sides thereof and adjacent to the three through-holes 18. The holes 16 are used for enabling the heat sink 10 to be firmly fixed to the lamp shell 30.

The two light modules 20 are strip-shaped and extend along the left-to-right direction. The two light modules 20 each include a plurality of LEDs 21 on a bottom face thereof. Each light module 20 includes a drive module 23. A length of each light module 20 is slightly larger than a sum of the length of the three through-holes 18 and less than that of the substrate 12. A width of each light module 20 is smaller than a distance between the front/rear face of the substrate 12 and an adjacent edge of a corresponding through-hole 18. A thickness of each light module 20 is about equal to that of the substrate 12. The two light modules 20 have the same shape and size and are respectively attached to the bottom surface of the substrate 12. One light module 20 is attached between the through-holes 18 and the front face of the substrate 12, the other light module 20 is attached between the through-holes 18 and the rear face of the substrate 12. In other words, the three through-holes 18 are located between the two light modules 20. A distance between one light module 20 and the three through-holes 18 is equal to that between the other light module 20 and the three through-holes 18. The light modules 20 emit light when they are in electrical connection with the external power.

The lamp shell 30 has a size matching the size of the substrate 12 of the heat sink 10. The lamp shell 30 includes a rectangular main portion 32 having the similar size to that of the substrate 12. A baffle 320 extends upwardly from four edges of the main portion 32. A height of the baffle 320 is at least twice as large as the thickness of the substrate 12. The baffle 320 is attached to the front, rear, left and right sides of the substrate 12 when the lamp shell 30 is fixed to the heat sink 10. The main portion 32, the baffle 320 and the substrate 12 of the heat sink 10 cooperatively construct a sealed housing. The two light modules 20 are received in the housing. A fixing wall 360 extends upwardly from the main portion 32 and near the baffle 320. The fixing wall 360 is parallel to the baffle 320 and has a height about equal to that of the light modules 20. A plurality of protrusions 361 extend from the fixing wall 360 toward the baffle 320. Each protrusion 361 is formed on an outer circumferential face of the fixing wall 360. Each protrusion 361 has a hole 36 corresponding to one of the holes 16 of the substrate 12. Three elongated through-holes 38 are defined in the middle of the main portion 32 corresponding to the through-holes 18 of the substrate 12. The three through-holes 38 of the lamp shell 30 have shapes and sizes similar to that of the three through-holes 18 of the heat sink 10. A fixing wall 380 extends upwardly from the main portion 32 and around the three through-holes 38. The fixing wall 380 separates the through-holes 38 from the light modules 20. A plurality of holes 36 are defined adjacent to the fixing wall 380 corresponding to the holes 16 near the through-holes 18 of the substrate 12. The main portion 32 defines a plurality of light transmission holes 34 between the fixing wall 360 and the fixing wall 380. The shapes, distribution and sizes of the light transmission holes 34 match with those of the LEDs 21. The plurality of lenses 40 are attached to a bottom surface of the main portion 32 corresponding to the light transmission holes 34.

When the LED lamp 100 is assembled, the two light modules 20 are attached to the bottom surface of the substrate 12 of the heat sink 10 and beside the three through-holes 18. The lamp shell 30 is fastened to the heat sink 10 by extending fasteners (not shown) through the holes 16 of the heat sink 10 into the holes 36 of the lamp shell 30. As viewed from FIG. 3, the fins 14 are partly exposed from the through-holes 18, 38. The lenses 40 are installed in the light transmission holes 34. Alternatively, the lenses 40 can also be made integrally with the lamp shell 30. When the LED lamp 100 is working, the LEDs 21 emit light and lenses 40 change an illumination distribution of the light from the LEDs 21. At the same time, the heat produced by the working LEDs 21 is transferred to the fins 14, and the fins 14 dissipate the heat to a surrounding environment.

Since the through-holes 18, 38 communicate airflow channels between adjacent fins 14 with a space below the substrate 12, an airflow can flow from the through holes 38, 18 along a vertical direction through the airflow channels between the fins 14, in addition to a horizontal direction through airflow channels between the fins 14, so the heat can be dissipated quickly by the fins 14. Furthermore, a width of each through hole 18 only occupies a small ratio of a length of a corresponding fin 14, whereby fixing of the fins 14 to the substrate 12 is not significantly affected. In addition, because the light modules 20 are received in the sealed housing which is isolated from an outside environment, dust is avoided from contaminating the light modules 20.

It is believed that the present disclosure and its advantages will be understood from the foregoing description, and it will be apparent that various changes may be made thereto without departing from the spirit and scope of the present disclosure or sacrificing all of its material advantages, the examples hereinbefore described merely being preferred or exemplary embodiments.

What is claimed is:

1. An LED lamp, comprising:

a heat sink comprising a substrate having a top face, a bottom face and a lateral surface connecting the top face and the bottom face respectively, and a plurality of fins extending from the top face of the substrate, airflow channels being defined between the fins;

a lamp shell fixed to the substrate; and a light module received in a space between the bottom face of the heat sink and the lamp shell;

wherein the substrate defines three first heat-dissipating through-holes throughout the top face and the bottom face of the substrate, the three first heat-dissipating through-holes extending along a lengthwise direction of the substrate, and a middle one of the three first heat-dissipating through holes having a size larger than that of the other two of the three first heat-dissipating through-holes, the three first heat-dissipating through-holes communicating airflow channels between the fins with the space between the bottom face of the substrate of the heat sink and the lamp shell, the lamp shell comprising three second heat-dissipating through-holes corresponding to the three first heat-dissipating through-holes of the substrate, and the three second heat-dissipating through-holes communicating the three first heat-dissipating through-holes via the space between the bottom face of the heat sink and the lamp shell;

a first fixing wall surrounding the three second heat-dissipating through-holes, the first fixing wall being a continuous wall and the first fixing wall separating the three second heat-dissipating through-holes from the light module; and a second fixing wall surrounding the first fixing wall, the second fixing wall being a continuous wall and top ends of the first fixing wall and the second fixing wall both attach to and abut the bottom face of the substrate to define a sealed space isolated from an outside environment and receiving the light module therein.

2. The LED lamp of claim 1, wherein each fin has a height ranging between 20 mm and 30 mm.

3. The LED lamp of claim 1, wherein every two adjacent fins are spaced from each other via a distance ranging between 3 mm and 8 mm and each airflow channel is between the every two adjacent fins.

4. The LED lamp of claim 1, wherein a ratio of a height of each fin to a distance between every two adjacent fins is 8:3.

5. The LED lamp of claim 1, wherein the first heat-dissipating through-holes are perpendicular to the fins, and the lamp shell is fixed to a periphery of the substrate.

6. The LED lamp of claim 5, wherein the light module is attached to the bottom face of the substrate, without extending to block the first heat-dissipating through-holes.

7. The LED lamp of claim 1, wherein the first heat-dissipating through-holes are elongated and defined in a middle of the substrate.

8. The LED lamp of claim 7 further comprising another light module, wherein the light module and the another light module are located at two opposite sides of the first heat-dissipating through-holes and extend along a lengthwise direction of the first heat-dissipating through-holes.

9. The LED lamp of claim 1, wherein the lamp shell comprises a main portion and a baffle extending upwardly from a periphery of the main portion, and the baffle covers an outer circumferential face of the substrate.

10. The LED lamp of claim 1, wherein the light module comprises a plurality of LEDs and a drive module.

11. The LED lamp of claim 10 further comprising a plurality of lenses, the lamp shell comprising a plurality of light transmission holes corresponding to the LEDs of the light module, and the lenses cover the light transmission holes.

12. The LED lamp of claim 1, wherein the bottom face and the lateral surface of the substrate are received in the lamp shell.

13. An LED lamp, comprising:

a heat sink comprising a substrate having a top face, a bottom face and a lateral surface connecting the top face and the bottom face respectively, and a plurality of fins extending from the top face of the substrate, airflow channels being defined between the fins;

a lamp shell fixed to the substrate; and a light module received in a space between the bottom face of the heat sink and the lamp shell;

wherein the substrate defines three first heat-dissipating through-holes throughout the top face and the bottom face of the substrate, the three first heat-dissipating through-holes extending along a lengthwise direction of the substrate, and a middle one of the three first heat-dissipating through holes having a size larger than that of the other two of the three first heat-dissipating through-holes, the three first heat-dissipating through-holes communicating airflow channels between the fins with the space between the bottom face of the substrate of the heat sink and the lamp shell, the lamp shell comprising a second heat-dissipating through-hole corresponding to the three first heat-dissipating through-holes of the substrate, and the second heat-dissipating through-hole communicating the three first through-holes via the space between the bottom face of the heat sink and the lamp shell.

14. The LED lamp of claim 13, wherein the bottom face and the lateral surface of the substrate are received in the lamp shell.

* * * * *